US005398106A

United States Patent [19]

Eguchi

[11] Patent Number: 5,398,106

[45] Date of Patent: Mar. 14, 1995

[54] IMAGE FORMING APPARATUS UTILIZING REPLACEABLE IMAGE FORMING CARTRIDGE AND DETECTING MEANS

[75] Inventor: Tatsuya Eguchi, Toyohashi, Japan

[73] Assignee: Minolta Camera Kabushiki Kaisha, Osaka, Japan

[21] Appl. No.: 209,488

[22] Filed: Mar. 14, 1994

Related U.S. Application Data

[63] Continuation of Ser. No. 998,599, Dec. 30, 1992.

[30] Foreign Application Priority Data

Jan. 21, 1992 [JP] Japan ..... 4-008441

[51] Int. Cl.[6] ..... G03G 15/06

[52] U.S. Cl. ..... 355/260; 118/694; 355/203

[58] Field of Search ..... 355/200, 203, 208, 210, 355/211, 245, 246, 260; 118/691, 694; 222/DIG. 1

[56] References Cited

U.S. PATENT DOCUMENTS

| | | | |
|---|---|---|---|
| 4,506,804 | 3/1985 | Oka | 222/64 |
| 4,646,679 | 3/1987 | Ohno et al. | 118/691 |
| 4,791,454 | 12/1988 | Takahashi et al. | 355/260 X |
| 4,963,929 | 10/1990 | Ueda et al. | 355/215 |
| 4,999,676 | 3/1991 | Mouri | 355/246 |
| 5,036,358 | 7/1991 | Yoshida | 355/203 |
| 5,182,601 | 1/1993 | Hodoshima et al. | 355/245 |
| 5,194,897 | 3/1993 | Yoshiyama et al. | 355/215 |

FOREIGN PATENT DOCUMENTS

| | | |
|---|---|---|
| 58-114081 | 7/1983 | Japan . |
| 59-46391 | 11/1984 | Japan . |
| 60-80879 | 5/1985 | Japan . |
| 60-128469 | 7/1985 | Japan . |
| 61-109080 | 5/1986 | Japan . |
| 64-6986 | 1/1989 | Japan . |
| 1-196086 | 8/1989 | Japan . |
| 0316765 | 12/1989 | Japan . |
| 0319065 | 12/1989 | Japan . |

*Primary Examiner*—William J. Royer

*Attorney, Agent, or Firm*—Burns, Doane, Swecker & Mathis

[57] ABSTRACT

An image forming apparatus of a type employing the replaceable image forming unit includes a detecting device for detecting an amount of rays of light having passed across a developer hopper, and a determining device for comparing the amount of light detected by the detecting device with a predetermined threshold value to determine the presence or absence of the image forming unit within the pocket. The detection of whether or not the image forming unit has been loaded into the pocket is possible regardless of the condition of the stirrer blade assembly within the hopper, that is, regardless of whether or not the stirred blade assembly is being driven.

14 Claims, 7 Drawing Sheets

IMAGE FORMING APPARATUS UTILIZING REPLACEABLE IMAGE FORMING CARTRIDGE AND DETECTING MEANS

This application is a continuation of application Ser. No. 07/998,599, filed Dec. 30, 1992.

BACKGROUND OF THE INVENTION

1. Field of the Invention

The present invention relates to an electrophotographic image forming apparatus such as, for example, an electrophotographic copying machine or an electrophotographic printer, of a type employing a replaceable image forming unit or cartridge including a photosensitive drum and a developing device.

2. Description of the Related Art

An image forming apparatus, for example, a printer, of a type wherein a image forming cartridge including a photo-sensitive drum and a developing device is replaceable relative to the body of the printer is well known such as disclosed in, for example, U.S. Pat. No. 4,791,454 issued Dec. 13, 1988, and U.S. Pat. No. 5,036,358 issued Jul. 30, 1991, and the Japanese Laid-open Patent Publications No. 1-316765 published Dec. 21, 1989, and No. 1-319065 published Dec. 25, 1989.

Of those prior art references, the Japanese Laid-open Patent Publication No. 1-319065 discloses a system for detecting whether or not the replaceable image forming cartridge is installed inside the image forming apparatus and also the amount of a developing material contained in a developer container. This known system comprises windows formed in a wall, defining a developer container, a transparent windowpane covering each of the windows, a stirrer blade assembly rotatably supported within the developer container and having cleaning members that sweeps the windowpanes during the rotation of the stirrer blade assembly while stirring the developing material, a light emitting element for emitting rays of light and a light receiving element for receiving the rays of light emitted by the light emitting element. In this known system, while the light emitting and receiving elements are installed in the body of the printer, the rays of light emitted by the light emitting element are adapted to enter the developer chamber through one of the transparent windowpanes and then emerge outwardly from the developer chamber through the otherof the windowpanes towards the light receiving element.

More specifically, the detecting system disclosed in the publication No. 1-319065 is such that, when the image forming apparatus is electrically powered on, a signal necessary to drive the stirrer blade assembly in the image forming unit is outputted and, at the same time, the light emitting element is electrically energized to emit rays of light. The rays of light emitted from the light emitting element travel towards the light receiving element across a portion of the housing, forming the replaceable image forming unit, by way of the transparent windowpanes.

The light receiving element provides an output which is classified into of one of three different patterns depending on particulars of the image forming cartridge, that is, the presence or absence of the image forming cartridge within the image forming apparatus and/or the presence or absence of the developing material within the hopper in the image forming cartridge. Specifically, when the light receiving element receives the incoming light at all times without being intercepted by the stirrer blade assembly, the output from the light receiving element represents a first pattern descriptive of the presence of the image forming cartridge inside the image forming apparatus; when the light receiving element receives the incoming light which is cyclically intercepted by the stirrer blade assembly then rotating in one direction, the output from the light receiving element represents a second pattern descriptive of an insufficient amount of developing material contained in the hopper; and when the light receiving element receives no incoming light because the latter is intercepted by the mass of the developing material within the hopper regardless of an operating condition of the stirrer blade assembly, the output from the light receiving element represents a third pattern descriptive of a sufficient amount of developing material contained in the hopper.

However, the prior art detecting system discussed above requires a drive system for the entire image forming apparatus to be activated to drive the stirrer blade assembly regardless of the presence or absence of the image forming cartridge loaded inside the image forming apparatus. In other words, this prior art image forming apparatus is required to be unnecessarily operated for the detecting system to work for a predetermined length of time prior to an actual image forming cycle taking place.

SUMMARY OF THE INVENTION

The present invention has been devised to substantially eliminate the problems inherent in the above discussed prior art image forming apparatus of the particular type and is intended to provide an improved image forming apparatus of a similar type wherein the absence of the image forming unit within a pocket defined in the image forming apparatus can be determined quickly and without requiring the stirrer blade assembly to be driven for detection purpose.

To this end, the present invention provides an image forming apparatus of a type employing the replaceable image forming unit, which apparatus comprises a detecting means for detecting an amount of rays of light having passed across a developer hopper, and a determining means for comparing the amount of light detected by the detecting means with a predetermined threshold value to determine the presence or absence of the image forming unit within the pocket.

According to the present invention, the presence or absence of the replaceable image forming unit within the pocket in the image forming apparatus is detected in terms of the amount of light received by the light receiving element. Therefore, the detection of whether or not the image forming unit has been loaded into the pocket is possible regardless of the condition of the stirrer blade assembly within the hopper, that is, regardless of whether or not the stirred blade assembly is being driven.

Preferably, the developer hopper has a pair of openings defined therein on opposite sides thereof and covered by semitransparent windowpanes so that the rays of light emitted by the light emitting element can pass across the developer hopper. Since the semitransparent windowpanes are effective to attenuate the amount of rays of light passing therethrough, the amount of light received by the light receiving element when the image forming unit is in the pocket and that when the image forming unit is out of the pocket are differentiated distinctly. Therefore, it is clear that a precise and accurate detection of the presence or absence of the image forming unit within the pocket is possible.

BRIEF DESCRIPTION OF THE DRAWINGS

This and other objects and features of the present invention will become clear from the following description taken in conjunction with a preferred embodiment thereof with reference to the accompanying drawings, in which like parts are designated by like reference numerals and in which.

DETAILED DESCRIPTION OF THE EMBODIMENT

In describing a preferred embodiment of the present invention, the present invention will be described as applied to an electrophotographic printer that is generally used as one of auxiliary devices peripheral to a computer for the sake of brevity. Those skilled in the art would readily understand upon reading of the disclosure herein set forth that the following description is made solely for the purpose of illustration and the present invention is equally applicable to any other image forming apparatus, for example, an electro-photographic copying machine as well.

Figure 1:
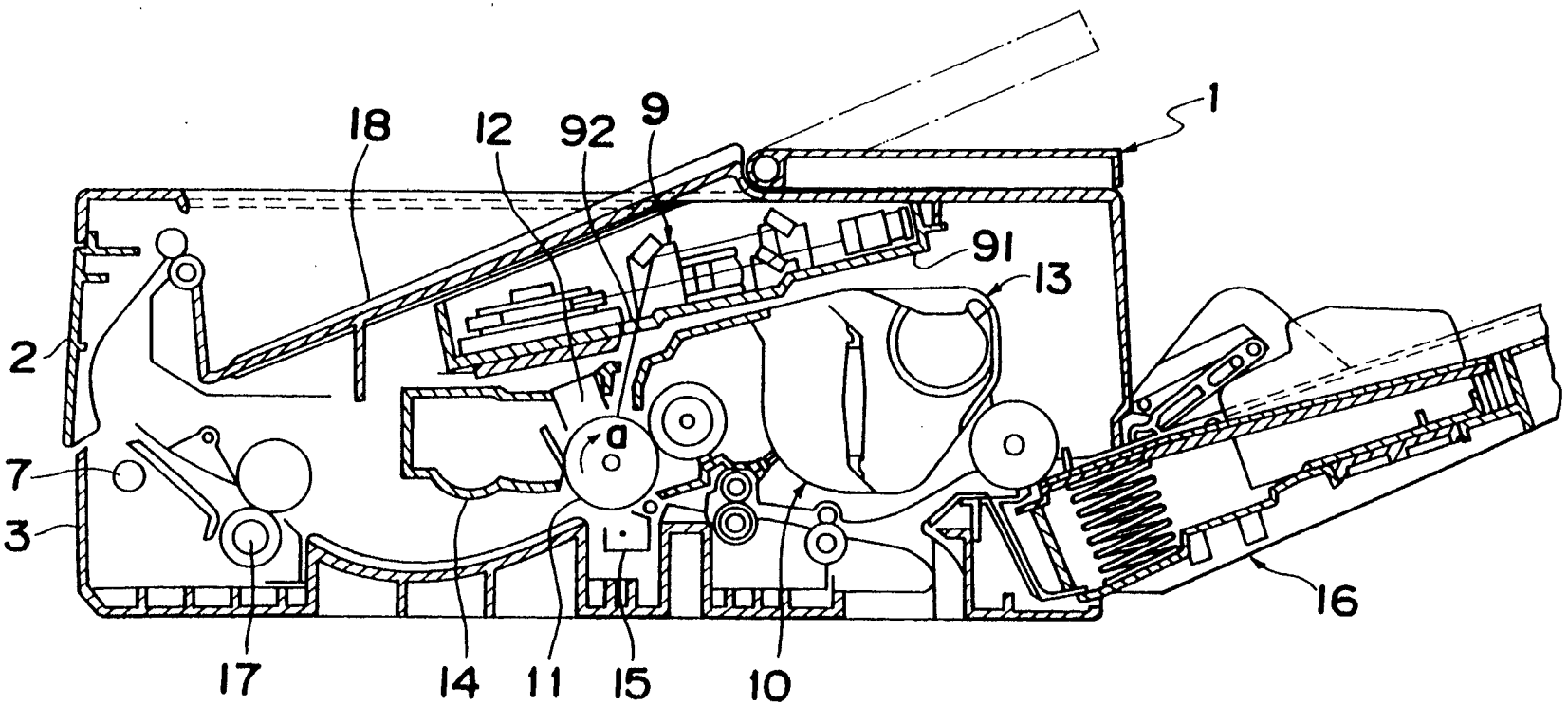
FIG. 1 is a schematic side sectional view of an electrophotographic image forming apparatus embodying the present invention.
Figure 2:
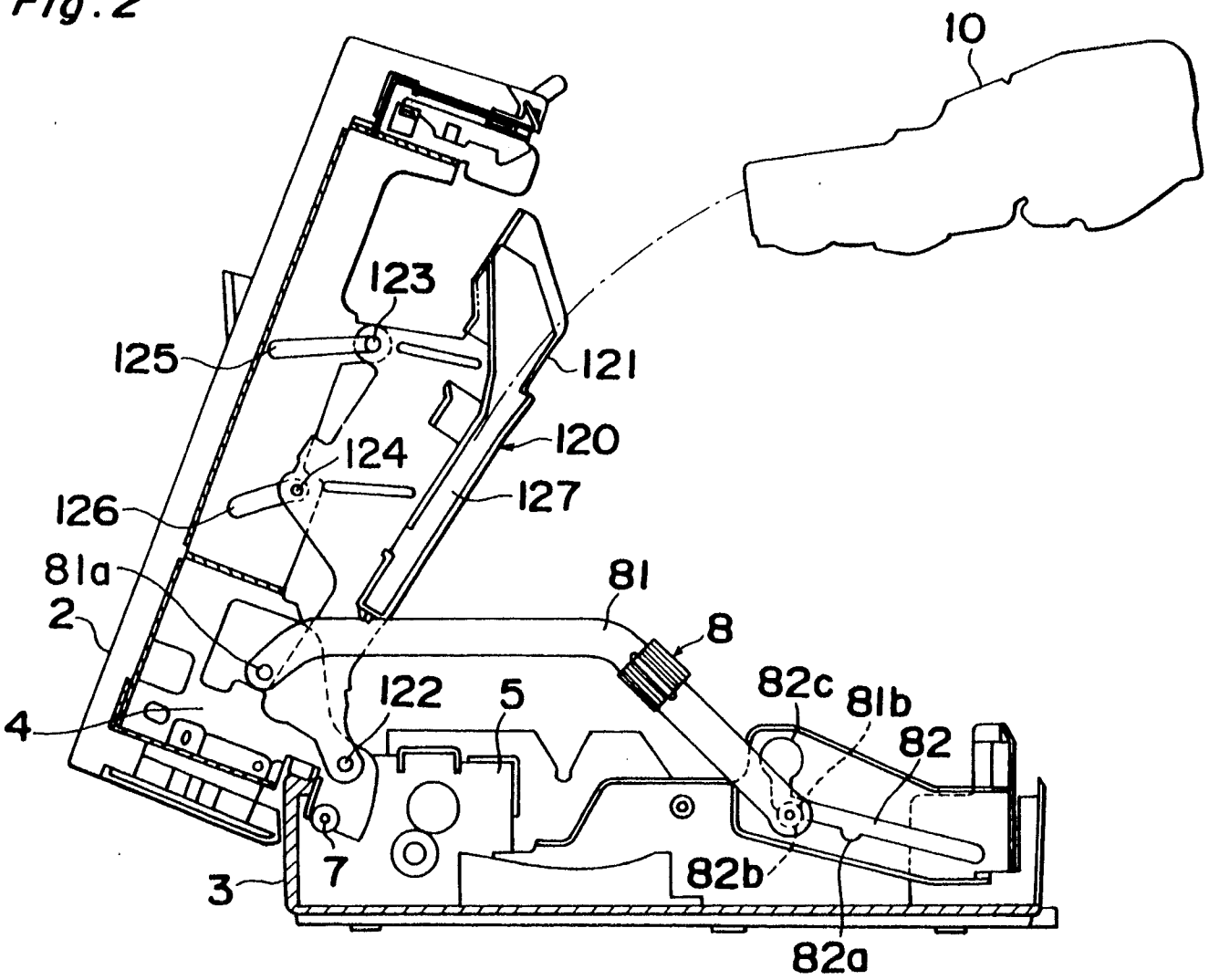
FIG. 2 is a schematic side sectional view of the electrophotographic image forming apparatus shown in FIG. 1, showing a top unit pivoted to an open position relative to a base unit.

Referring first to FIGS. 1 and 2 showing the printer in its entirety in a schematic side sectional representation, the printer 1 is of a generally rectangular box-like configuration and includes a top housing unit 2 and a base housing unit 3. The top housing unit 2 has a pair of side frames 4 spaced apart from each other and, similarly, the base housing unit 3 has a pair of side frames 5 spaced apart from each other. The top and base housing units 2 and 3 are coupled together by means of stud shafts 7 so that the top housing unit 2 may be pivotable relative to the base housing unit 3 about a common axis coaxial with the stud shafts 7 between a closed position as shown in FIG. 1 and an opened position as shown in FIG. 2. The stud shafts 7 may have one end integral or rigid with the respective side frames of one of the top and base housing units 2 and 3 and, in such case, the stud shafts 7 are the opposite end rotatably received in respective bearing holes defined in the side frames of the other of the top and base housing units 2 and 3, although a single shaft may be employed in place of the stud shafts 7.

It is to be noted that the top housing unit 2 is normally biased by a spring element (not shown) so as to pivot towards the opened position for the ease of selective opening and closing of the top housing unit 2 relative to the base housing unit 3 and that the top housing unit 2 when pivoted towards the opened position can be locked at one of some intermediate positions between the opened and closed positions by means of an adjustable lock mechanism 8 which will now be described.

As best shown in FIG. 2, the adjustable lock mechanism 8 includes a generally angled lock arm 81 pivotally connected at one end to one of the side frames 4 in the top housing unit 2 by means of a connecting pin 81*a*. This lock arm 81 has the opposite end carrying an anchor pin 81*b* which is slidably engaged in a guide groove 82 defined in the adjacent side frame 5 in the base housing unit 3. So far shown in FIG. 2, the guide groove 82 has three detent recesses 82*a*, 82*b* and 82*c* defined along the length of the guide groove 82; said detent recess 82*c* defines the opened position for the top housing unit 2 while end of the guide groove 82 opposite to the detent recess 82*c* defined the closed position for the top housing unit 2. The detent recesses 82*a* and 82*b* define respective intermediate positions for the top housing unit 2 and, hence, when the anchor pin 81*b* rigid with the lock arm 81 is trapped into one of the detent recesses 82*a* and 82*b* in the course of the pivotal movement of the upper housing unit 2 from the closed position towards the opened position, the top housing unit 2 forms an angle relative to the base housing unit 3 which is smaller than the angle assumed when the top housing unit 2 is in the opened position. Thus, the adjustable lock mechanism 8 is so designed as to adjust the opening of the top housing unit 2 relative to the base housing unit 3.

An optical unit 9 is carried by the top housing unit 2 for movement together therewith. This optical unit 9 includes an open-topped casing 91 opening upwardly and accommodating therein a laser and various optical elements such as a polygonal mirror assembly operable to deflect an imagewise laser beam generated by the laser and subsequently modulated according to an image data to be printed on a recording medium. The casing 91 has a bottom wall in which an exposure slit 92 is defined for emission of the imagewise laser beam therethrough towards a photosensitive drum 11 as will be described later.

Figure 3:
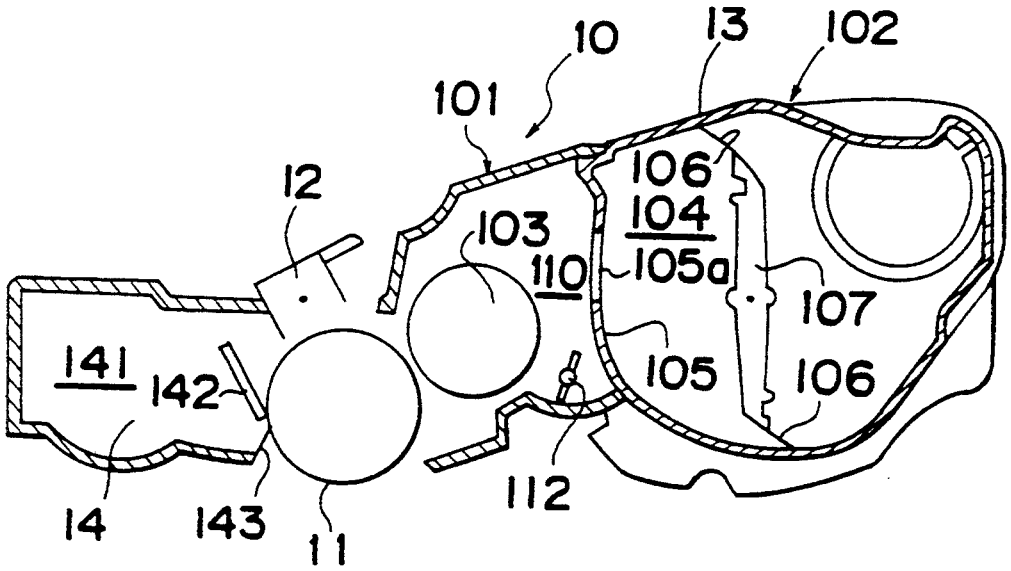
FIG. 3 is a schematic side sectional view of a replaceable image forming cartridge used in the electro-photographic image forming apparatus of the present invention.
Figure 4:
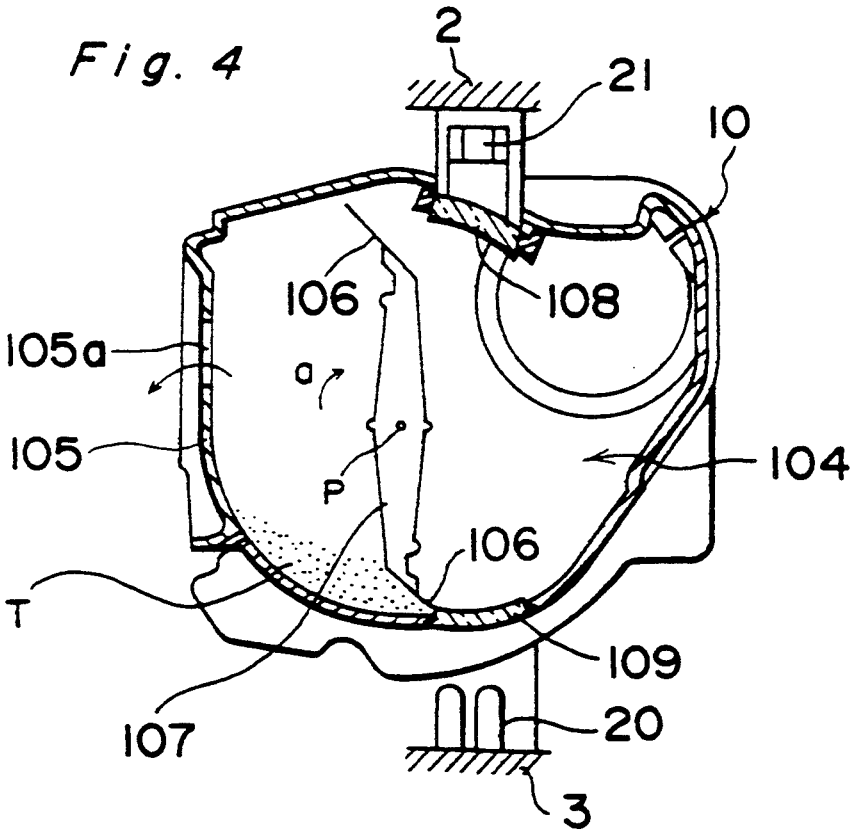
FIG. 4 is a schematic side sectional view of a portion of the replaceable image forming cartridge shown in FIG. 3.

The illustrated printer 1 also includes, as best shown in FIGS. 3 and 4, a replaceable image forming unit or cartridge 10 comprising a unitary assembly of the photosensitive drum 11, an electrostatic charger 12, a developing device 13 and a cleaning device 14. The photosensitive drum 11 comprises a cylindrical body made of aluminum and having an outer peripheral surface formed with a photosensitive layer as is well known to those skilled in the art. This image forming cartridge 10 is detachably mounted in a pocket defined in the upper housing unit 2 as will be described later in detail and, therefore, the photosensitive drum 11 has a driven gear coaxially connected to one end thereof for engagement with a drive gear, installed in the base housing unit 3, when the top housing unit 2 is pivoted to the closed position.

Referring still to FIGS. 3 and 4, the developing device 13 includes a developing subunit 101 and a hopper 102 separated from the developing subunit 101 by a partition wall 105 having a supply port 105*a* defined therein. The developing subunit 101 accommodates therein a developing roll 103 supported therein for rotation in one direction and positioned adjacent an opening that opens towards the photosensitive drum 11. The hopper 102 includes a container 104 for accommodating a mass of developing material, for example, toner. This container 104 is communicated with the developing subunit 101 through the supply port 105*a* and accommodates therein a generally elongated stirrer blade assembly 107 supported at an intermediate portion thereof for rotation in one direction within the container 104. The elongated stirrer blade assembly 107 has its opposite ends to which respective cleaning members 106, each being in the form of a film of polyester, are secured.

As best shown in FIG. 4, top and bottom portions of the wall defining the container 104, which are generally opposite to each other with respect to an axis of rotation of the stirrer blade assembly 107 are perforated to provide respective detecting windows which are covered by semitransparent windowpanes 108 and 109. As will be described later, during the rotation of the stirrer blade assembly 107 in one direction shown by the arrow a, the cleaning members 106 carried by the stirrer blade assembly 107 sweep these semitransparent windowpanes 108 and 109 to keep the latter clean at all times. Preferably, at least the semitransparent windowpanes 108 and 109 are so curved as to follow the curvature along which the cleaning members 106 move during the rotation of the stirrer blade assembly 107, thereby to ensure an exact and uniformsweeping of the windowpanes 108 and 109.

A generally rectangular-sectioned rear peripheral edge of the wall defining the developing subunit 101 is firmly bonded by the use of any suitable bonding agent to a similarly sectioned front peripheral wall portion of the container 102 adjacent the partition wall 105 to integrate the developing subunit 101 and the container 102 together, although a single casing structure may be employed for the developing subunit 101 and the container 102. The developing roll 103 within the developing subunit 101 is so positioned and so supported that a buffer space 110 can be defined within the developing subunit 101 and between the developing roll 103 and the partition wall 105.

The cleaning device 14 comprises a toner recovery box 141 having an opening defined a box defining wall so as to open towards the photosensitive drum 11, a cleaning blade 142 supported within the toner recovery box 141 at a location adjacent the opening in the box defining wall and having one of opposite side edges thereof held in sliding contact with the photosensitive roll 11, and a sealing member 143 in the form of a film of, for example, polyurethane.

As hereinbefore briefly described, the image forming cartridge 10 is removably mounted in the pocket defined in the upper housing unit 2. For this purpose, the upper housing unit 2 includes a pocket defining structure generally identified by 120 in FIG. 2. This pocket defining structure 120 comprises a pair of side plates 121 (only one of which is shown in FIG. 2) spaced apart from each other in a direction parallel to the axis of pivot of the upper housing unit 2 relative to the base housing unit 3 and pivotally connected at one end to the side frames 4 by means of respective stud shafts 122 for movement between a closed position as shown in FIG. 1 and a receiving position as shown in FIG. 2. Each of the side plates 121 has a pair of guide pins 123 and 124 secured thereto and spaced apart from each other in a direction lengthwise of the respective side plate 121. These guide pins 123 and 124 on each side plate 121 are engaged in respective curved guide grooves 125 and 126 defined in each of opposite side wall portion of the upper housing unit 2 so as to define the angular distance between the closed and receiving positions for the movement of the pocket defining structure 120. Each of the guide grooves 125 and 126 is so shaped and so curved as to follow the path of an angular movement of the pocket defining structure 120 about a common axis coaxial with the stud shafts 122 and, therefore, during the pivotal movement of the side plates 121 and, hence, the pocket defining structure 120, between the closed and receiving positions.

Generally U-sectioned guide rails 127 are rigidly secured to respective base portions of the side plates 121 with their openings confronting with each other in a direction parallel to the axis of pivot of the pocket defining structure 120 for receiving elongated lateral projections integral or rigid with the image forming cartridge 10. More specifically, the pocket defining structure 120 is so structured and so configured that, when the pocket defining structure 120 is in the receiving position as shown in FIG. 2, the image forming cartridge 10 can be inserted into the pocket with the lateral projections received in and guided along the U-sectioned guide rails 127 to occupy a mounted position at which the image forming cartridge 10 is seated between the side plates 121. After the mounting of the image forming cartridge 10 in the pocket, a disengagement of the anchor pin 81*b* from the detent recess 82*c* defining the opened position for the upper housing unit 2 allows the upper housing unit 2 to be pivoted towards the closed position. As the upper housing unit 2 is pivoted towards the closed position, the pocket defining structure 120 accommodating therein the image forming cartridge 10 is also pivoted from the receiving position towards the closed position, and generally simultaneously with the arrival of the upper housing unit 2 at the closed position as shown in FIG. 1, the pocket defining structure 120 is brought to the closed position to retain the image forming cartridge 10 in position inside the printer 1.

It is to be noted that, when the upper housing unit 2 is brought to the closed position with the image forming cartridge 10 having been accommodated in the pocket defining structure 120 in the manner described above, all of the photosensitive drum 11, the developing roll 103, the stirrer blade assembly 107 and other movable elements all accommodated in the image forming cartridge 10 are drivingly coupled with a drive system installed inside the base housing structure 3 in any known manner.

The printer 1 of the above described construction operates in the following manner. With particular reference to FIG. 1, assuming that the photosensitive drum 11 is driven clockwise as viewed in FIG. 1, the photosensitive drum 11 is electrostatically charged at a charging station to a predetermined potential by the electrostatic charger 12 and is subsequently moved past an exposure station. At the exposure station, the electrostatically charged outer peripheral surface of the photosensitive drum 11 is exposed to the imagewise laser beam projected thereonto through the exposure slit 92, thereby to form an electrostatic latent image in a pattern corresponding to an image to be printed. Thereafter, the photosensitive drum 11 is moved past a developing station at which the electrostatic latent image is developed by the developing device 13 into a powdery toner image which is, when the photosensitive drum 11 being rotated arrives at a transfer station, transferred by a transfer charger 15 onto a recording sheet that has been supplied from a sheet supply unit 16 in a timed fashion with the arrival of the photosensitive drum 11 at the transfer station.

The recording sheet carrying the powdery toner image so transferred from the photosensitive drum 11 is conveyed towards a fixing unit 17 at which the powdery toner image is permanently fixed on the recording sheet. The recording sheet bearing the fixed toner image is then ejected onto a sheet recovery tray 18. On the other hand, toner residue remaining on the outer peripheral surface of the photosensitive drum 11 is cleaned by and recovered into the cleaning device 14 which is positioned on a leading side of the transfer station with respect to the direction of rotation of the photosensitive drum 11.

Referring particularly to FIG. 3, at the time the electrostatic latent image on the photosensitive drum 11 is developed, toner within the buffer space 110 is forcibly transported towards the developing roll 103 by a stirrer blade 112 then driven clockwise. The toner so transported towards the developing roll 103 is conveyed by the rotation of the developing roll 103 towards the developing station, at which the developing roll 103 confronts the photosensitive drum 11, and is subsequently applied onto the photosensitive drum 11 to form the powdery toner image thereon. A portion of the toner left on the developing roll 103 without being applied onto the photosensitive drum 11 is transported by the rotation of the developing roll 103 back to the buffer space 110 and again to the developing station, circulating around the developing roll 103 while the amount of the toner within the buffer space 110 progressively decreases.

As the toner within the buffer space 110 is consumed in the manner described above, toner within the container 104 is replenished into the buffer space 110 through the supply port 105*a* to compensate for a reduction in amount of the toner within the buffer space 110. This replenishment is effected by the clockwise rotation of the stirrer blade assembly 107.

In any event, the structure and the operation of the printer 1 so far described are well known to those skilled in the art and are substantially disclosed in the Japanese Laid-open Patent Publication No. 2-210479 published Aug. 21, 1990, which corresponds to U.S. Pat. No. 5,036,358 issued Jul. 30, 1991, to Yoshida, reference to which is herein incorporated.

In accordance with the present invention, the printer 1 embodying the present invention is provided with means for detecting the presence or absence of the image forming cartridge 10 within the pocket and also the amount of toner remaining within the hopper. This will now be described in detail.

As hereinbefore described, the top and bottom portions of the wall defining the container 104, which are generally opposite to each other with respect to an axis of rotation of the stirrer blade assembly 107 are perforated to provide respective detecting windows which are covered by semitransparent windowpanes 108 and 109. The windowpane 108 in the top portion of the container defining wall is adapted to pass therethrough the rays of light towards a light receiving element 21 carried by the upper housing unit 2 so as to confront the windowpane 108 at all times so long as the image forming cartridge 10 is in the pocket. On the other hand, the windowpane 109 in the bottom portion of the container defining wall is adapted to pass therethrough rays of light emitted by a light emitting element 20 which is carried by the base housing unit 3 so as to confront the windowpane 109 when the upper housing unit 2 is in the closed position.

Figure 5:
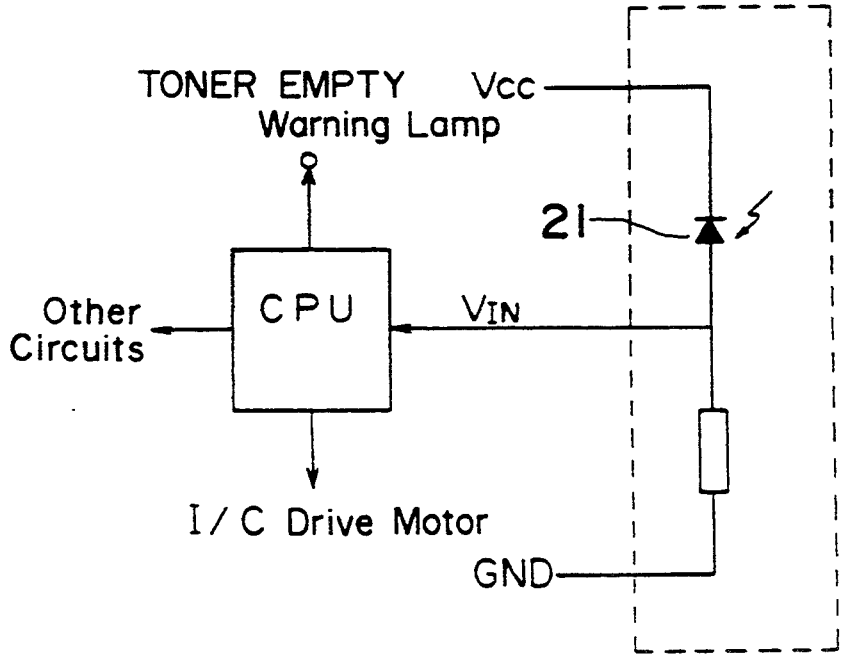
FIG. 5 is a schematic circuit diagram showing a light detecting circuit used in the practice of the present invention.

FIG. 5 illustrates a light detecting circuit for detecting the presence or absence of the image forming cartridge 10 within the pocket and also that of toner remaining within the container 104. The light receiving element 21 referred to above is inserted in this light detecting circuit so that a signal $V_{IN}$ indicative of the intensity of light received by the light receiving element 21 can be supplied to a microprocessor CPU. The microprocessor CPU operates in response to the inputted signal $V_{IN}$ to detect whether or not the image forming cartridge 10 has been accommodated within the pocket and also to detect whether or not the toner is still available within the container 104.

Figure 6:
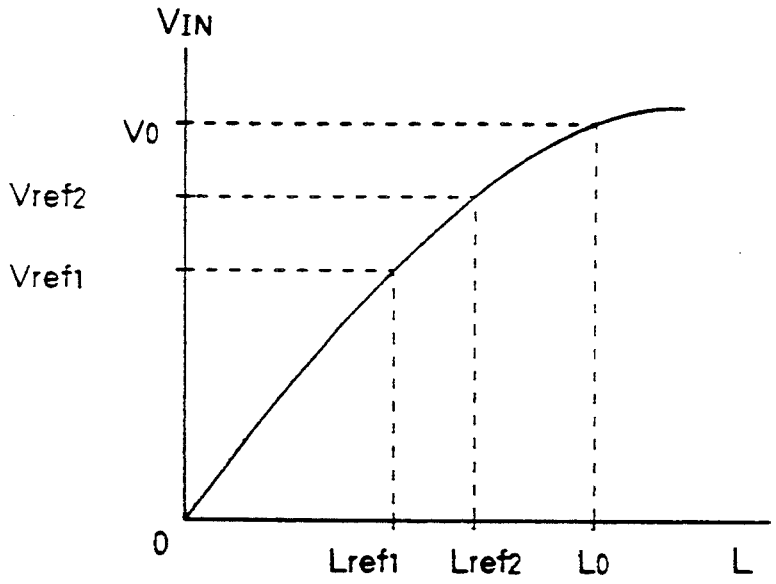
FIG. 6 is a graph showing a relationship between the amount of light detected by a light receiving element and an output voltage generated thereby.

For this purpose, the light receiving element 21 is of a type such an operating characteristic as to increase an output voltage $V_{IN}$ with an increase in amount L of light received thereby as shown in FIG. 6.

In the graph of FIG. 6, reference character $L_O$ represents the amount of light received by the light receiving element 21 when the image forming cartridge 10 is not received within the pocket, and the output voltage $V_{IN}$ generated from the light receiving element 21 at this time may attain a value indicated by $V_O$. This condition is hereinafter referred to as an "UNLOAD" condition.

Reference character $L_{ref2}$ represents the amount of light received by the light receiving element 21 when no toner is available within the container 104 although the image forming cartridge 10 is actually received within the pocket, and the output voltage $V_{IN}$ generated from the light receiving element 21 at this time may attain a value indicated by $V_{ref2}$. This condition is hereinafter referred to as a "NO TONER" condition.

Also, reference character $L_{ref1}$ represents the amount of light received by the light receiving element 21 when, although the image forming cartridge 10 is actually received within the pocket, the toner is accommodated within the container 104 in a quantity which would eventually result in a print of a low-density image, that is, which requires a replenishment of toner into the container 104, and the output voltage $V_{IN}$ generated from the light receiving element 21 at this time may attain a value indicated by $V_{ref1}$. This condition is hereinafter referred to as a "TONER EMPTY" condition.

The output voltage $V_O$ is a maximum possible value since, in the absence of the image forming cartridge 10 within the pocket, the substantially entire amount of the rays of light emitted from the light emitting element 20 are directly received by the light receiving element 21. However, so long as the image forming cartridge 10 is received within the pocket, the intervention of the semitransparent windowpanes 108 and 109 (each having, for example, a 80% light transmissivity) between the light emitting and receiving elements 20 and 21 reduces the amount of light received by the light receiving element 21 and, therefore, the output voltage $V_{IN}$ attains a value lower than the voltage $V_O$ referred to above.

In addition, assuming that the image forming cartridge 10 has been received within the pocket, that is, the semitransparent windowpanes 108 and 109 intervene the path of travel of light from the light emitting element 20 towards the light receiving element 21, the amount of light actually received by the light receiving element 21 varies with a change in amount of toner accommodated within the container 104. Specifically, if a sufficient amount of toner remains within the container 104, the toner within the container 104 sufficiently intercept the path of travel of light from the light emitting element 20 towards the light receiving element 21 and, therefore, the light receiving element 21 will receive a substantially zero or extremely small amount of light whereas, if the amount of toner remaining within the container 104 is very small, the light receiving element 21 will receive a large amount of light without substantially intercepted by the toner.

Figure 7:
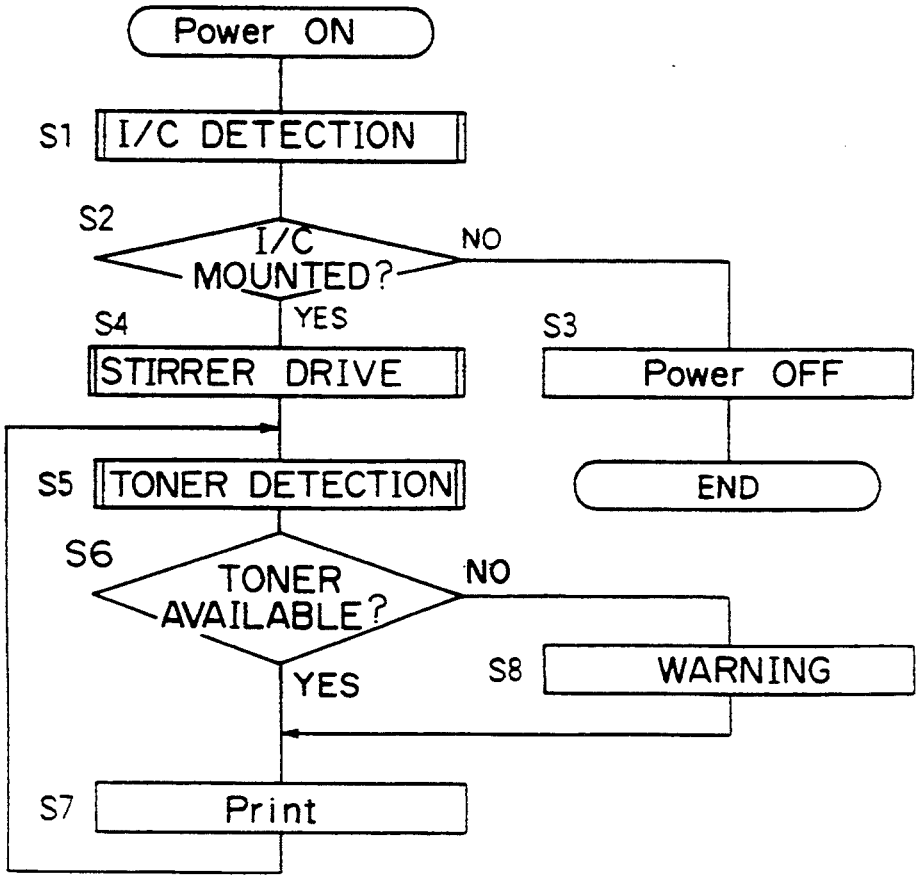
FIG. 7 is a flowchart showing a main routine executed by a central processing unit for detecting an installation of the replaceable image forming cartridge.

The microprocessor CPU is so programmed as to execute the routine shown in FIG. 7 to detect the presence or absence of the image forming cartridge 10 within the pocket and/or that of toner remaining within the container 104. Referring now to FIG. 7, assuming that the printer 1 is electrically powered on, the microprocessor CPU starts at "I/C DETECTION" step S1 a subroutine for detecting the presence or absence of the image forming cartridge 10 within the pocket, the details of which will be described later with reference to FIG. 8. Following step S1, a decision is made at "I/C MOUNTED?" step S2 to determine if the image forming cartridge 10 has been loaded in the printer 1, that is, received within the pocket. In the event that the image forming cartridge 10 has not yet been loaded, the program flow goes to "POWER OFF" step S3 to switch the printer 1 off. It is to be noted that, instead of switching the printer 1 off at step S3, arrangement may be made to cause the microprocessor CPU to issue a warning signal necessary to activate one or both of an alarm and a warning lamp to provide an indication that no replaceable image forming cartridge is loaded inside the printer 1.

On the other hand, the decision at step S2 indicates that the image forming cartridge 10 has been loaded, the microprocessor CPU causes the stirrer blade assembly 107 to be driven in the direction shown by the arrow a in FIG. 4 at "STIRRER DRIVE" step S4. Consequent upon the rotation of the stirrer blade assembly 107, toner T accommodated within the container 104 is uniformly mixed and, on the other hand, supplied into the developing subunit 101 through the supply port 105. At the same time, the rotation of the stirrer blade assembly 107 allows the cleaning members 106 to cyclically sweep the windowpanes 108 and 109 to keep the latter clean.

Subsequent to step S4, a "TONER DETECTION" subroutine is executed at step S5, the details of which will be described later with particular reference to FIG. 9. However, it is to be noted that, during the execution of the subroutine at step S5, one of the NO TONER condition and the TONER EMPTY condition is detected. In either case, a decision is made at "TONER AVAILABLE?" step S6 to determine if toner T is accommodated within the container 104 in a quantity sufficient to execute an image printing cycle. Should the decision at step S6 indicate that the sufficient amount of toner T is accommodated within the container 104, the image printing cycle at "PRINT" step S7 to provide a print, but should no sufficient amount of toner T be accommodated within the container 104, a warning lamp is energized at "WARNING" step S8 to provide a visual indication that the container 104 is empty of toner. Instead of or in combination with the energization of the warning lamp at step S8, arrangement may be made to interrupt the image printing cycle.

Figure 8:
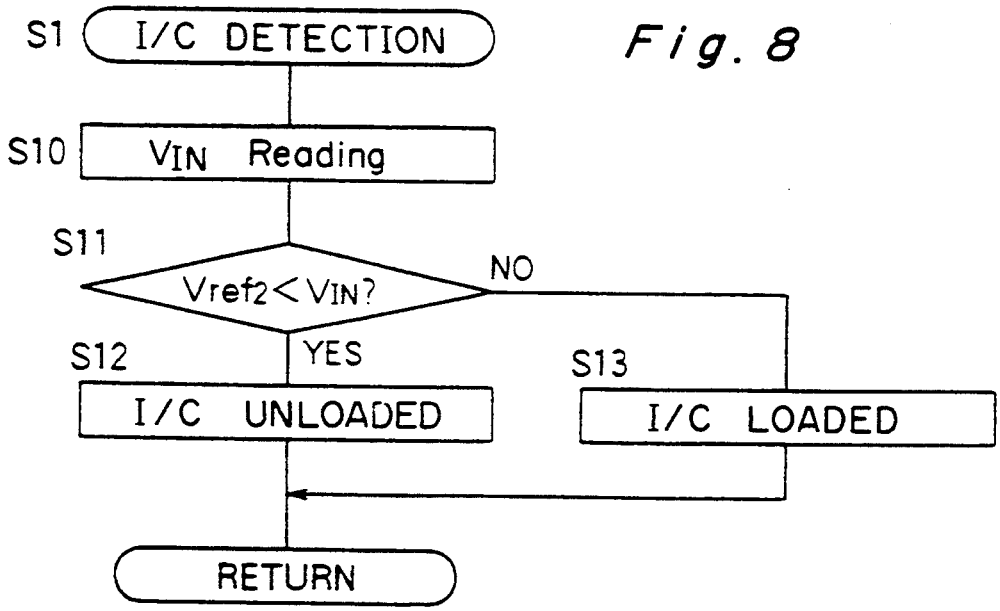
FIG. 8 is a flowchart showing a subroutine executed at step S1 of the main routine of FIG. 7.
Figure 10:
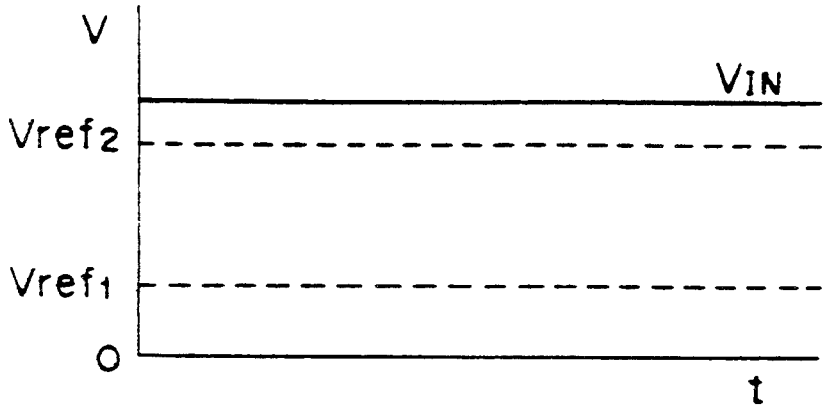
FIG. 10 is a diagram showing respective waveforms of outputs generated when the image forming cartridge is not installed.

Referring now to FIG. 8 showing the subroutine executed at step S1 of the main routine of FIG. 7, the subroutine starts with the microprocessor CPU reading the inputted voltage $V_{IN}$ at step S10. Then at step S11, the microprocessor CPU compares the inputted voltage $V_{IN}$ with the voltage $V_{ref2}$. This voltage $V_{ref2}$ corresponds to the voltage inputted to the microprocessor CPU when no toner is contained in the container 104 in the image forming cartridge 10, and therefore, a condition in which the voltage $V_{ref2}$ is lower than the inputted voltage $V_{IN}$ shown in FIG. 10 is descriptive of the UNLOAD condition discussed hereinbefore. On the other hand, a condition in which the voltage $V_{ref2}$ is higher than the inputted voltage $V_{IN}$ is descriptive of the loading, or presence, of the image forming cartridge 10 within the pocket.

Accordingly, if the voltage $V_{ref2}$ is lower than the inputted voltage $V_{IN}$ as determined at step S11, the microprocessor CPU executes "I/C UNLOADED" step S12 to formulate an electric "OFF" signal indicative of the absence of the image forming cartridge 10 within the pocket, but if the voltage $V_{ref2}$ is equal to or higher than the inputted voltage $V_{IN}$ as determined at step S11, the microprocessor CPU executes "I/C LOADED" step S13 to formulate an electric "ON" signal indicative of the presence of the image forming cartridge 10 within the pocket. Once the OFF signal is generated from the microprocessor CPU at step S12, the printer 1 is powered off and/or the warning is issued at step S3 of the main routine shown in FIG. 7.

It is to be noted that, even in the case where, although the toner T is contained within the container 104, the amount thereof is small and, yet, the stirrer blade assembly 107 is held still with the cleaning member 106 clear off the semitransparent windowpane 109 as shown in FIG. 4, the voltage $V_{IN}$ inputted from the light receiving element 21 to the microprocessor CPU will be of a value generally intermediate between the voltages $V_{ref1}$ and $V_{ref2}$ and is, therefore, quite distinct from the voltage signal indicative of the absence of the image forming cartridge 10 within the pocket which is lower higher than the voltage $V_{ref2}$. In other words, the microprocessor CPU operating in the environment of the present invention is effective to ascertain the presence or absence of the image forming cartridge 10 within the pocket regardless of whether or not the stirrer blade assembly 107 is driven.

Figure 9:
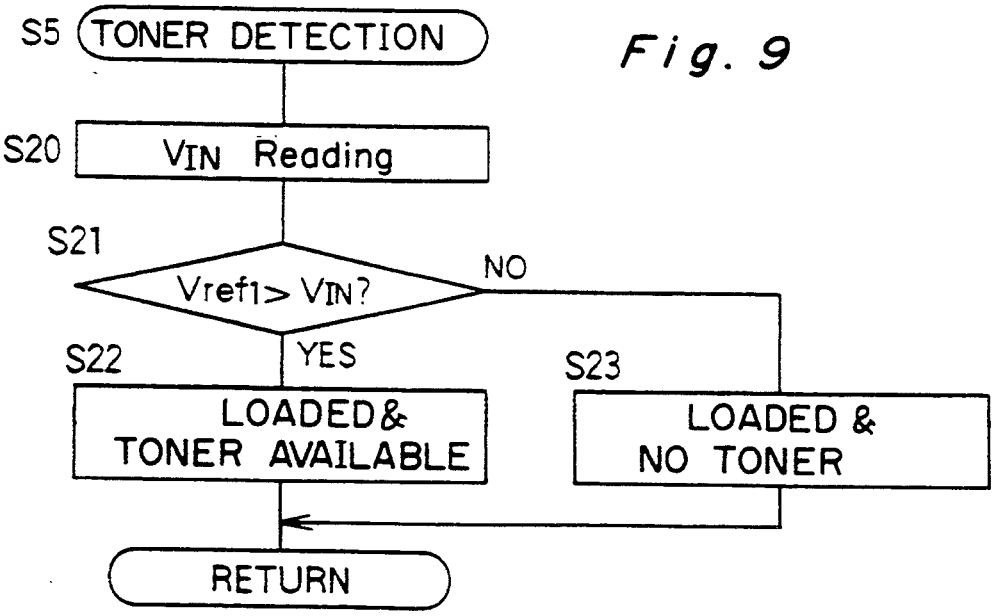
FIG. 9 is a flowchart showing another subroutine executed at step S5 of the main routine of FIG. 7.
Figure 11:
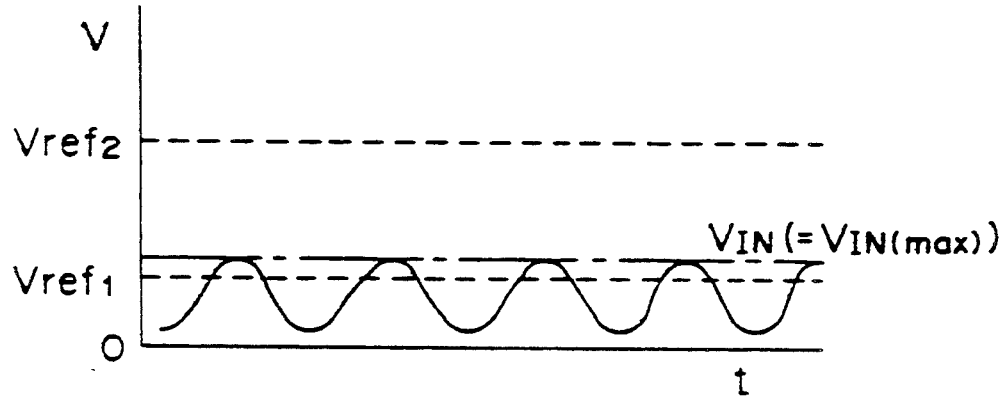
FIG. 11 is a diagram showing respective waveforms of the outputs generated when the image forming cartridge is installed, but no toner is contained therein.
Figure 12:
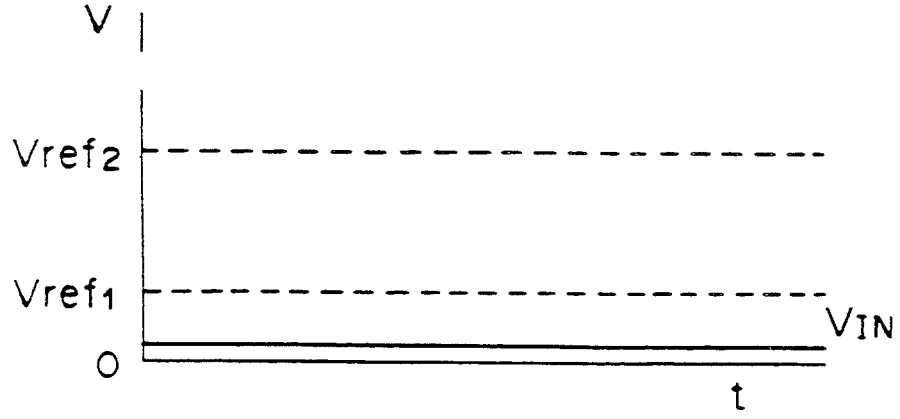
FIG. 12 is a diagram showing respective waveforms of the outputs generated when the image forming cartridge is installed and the toner is contained therein.

With reference to FIG. 9 showing the "TONER DETECTION" subroutine executed at step S5 of the main routine of FIG. 7, this subroutine starts with the microprocessor CPU reading the input voltage $V_{IN}$ at step S20. Then at step S21, the microprocessor CPU compares the inputted voltage $V_{IN}$ with the voltage $V_{ref1}$. As hereinbefore described, during the rotation of the stirrer blade assembly 107 within the container 104, the cleaning members 106 cyclically sweeps the semitransparent windowpanes 108 and 109 while uniformly mixing the toner T contained therein and, in unison therewith, the amount of toner deposited on the semitransparent windowpane 109 cyclically varies, accompanied by a variation in amount of light received by the light receiving element 21, that is, a variation in voltage $V_{IN}$ inputted to the microprocessor CPU as shown in FIG. 11.

The microprocessor CPU detects a maximum value $V_{IN(max)}$ of the voltage $V_{IN}$ then fluctuating cyclically with a change in amount of toner deposited on the windowpane 109 and then compare the maximum value $V_{IN(max)}$ with the voltage $V_{ref1}$. The voltage $V_{ref1}$ with which the maximum voltage $V_{IN(max)}$ is compared corresponds to the voltage inputted to the microprocessor CPU during the TONER EMPTY condition as hereinbefore described and, therefore, when the microprocessor CPU determines that the voltage $V_{ref1}$ is higher than the maximum voltage $V_{IN(max)}$, a signal descriptive of both of the presence of the image forming cartridge 10 within the pocket and the presence of the toner T within the container 104 is formulated at "LOADED & TONER AVAILABLE" step S22. However, when the microprocessor CPU determines that the voltage $V_{ref1}$ is equal to or lower than the maximum voltage $V_{IN(max)}$, a signal descriptive of both of the presence of the image forming cartridge 10 within the pocket and the absence of the toner T within the container 104 is formulated at "LOADED & NO TONER" step S23.

From the foregoing description of the preferred embodiment of the present invention, it is clear that, in the printer embodying the present invention, the presence or absence of the replaceable image forming cartridge within the pocket in the printer is detected in terms of the amount of light received by the light receiving element. Therefore, the detection of whether or not the image forming cartridge has been loaded into the pocket is possible regardless of the condition of the stirrer blade assembly within the hopper container, that is, regardless of whether or not the stirred blade assembly is driven.

Also, since the semitransparent windowpanes effective to attenuate the amount of rays of light passing therethrough are disposed on the path of travel of the rays of light from the light emitting element to the light receiving element, the amount of light received by the light receiving element when the image forming cartridge is in the pocket and that when the image forming cartridge is out of the pocket are differentiated distinctly, and it is, therefore, clear that a precise and accurate detection of the presence or absence of the image forming cartridge within the pocket is possible.

Although the present invention has been described in connection with the preferred embodiment thereof with reference to the accompanying drawings, it is to be noted that various changes and modifications are apparent to those skilled in the art. By way of example, although both of the windowpanes 108 and 109 have been described as made of a semitransparent material, the present invention can work satisfactorily even if one of the windowpanes 108 and 109 is made of a semitransparent material and the other of them is made of transparent material.

An alternative method may be contemplated that, while both of the windowpanes 108 and 109 are made of a transparent material, the use is made of a filter effective to attenuate the amount of light travelling from the light emitting element 20 towards the light receiving element 21.

Accordingly, such changes and modifications are to be understood as included within the scope of the present invention as defined by the appended claims, unless they depart therefrom.

What is claimed is:

1. An image forming apparatus of a type utilizing a replaceable image forming unit, said image forming unit including a developer hopper for accommodating a mass of developing material, said apparatus comprising:

means for detecting rays of light having passed across the developer hopper; and means for comparing the amount of light detected by the detecting means with a predetermined threshold value to determine whether or not the image forming unit is installed, depending on a result of detection performed thereby.

2. The image forming apparatus as claimed in claim 1, wherein said developer hopper has a pair of detecting windows made of semitransparent material.

3. The image forming apparatus as claimed in claim 1, wherein said predetermined threshold value represents the amount of light detected by the detecting means when the developer hopper is empty and wherein said detecting means determines that the image forming unit is not installed, when the result of detection performed by the detecting means is greater than the predetermined threshold value.

4. An image forming apparatus which comprises:

a replaceable image forming unit including a developer hopper for accommodating a mass of developing material therein, said developer hopper having an incident window through which external rays of light enter the developer hopper and an exit window through which the rays of light having entered the developer hopper emerge outwardly;

means for stirring the developing material within the developer hopper;

a pocket defining structure having a pocket defined therein for replaceably receiving therein the image forming unit;

a light receiving means disposed so as to confront the exit window of the developer hopper;

means for determining whether or not the image forming unit is installed within the pocket in accordance with the amount of the rays of light received by the light receiving means without regard to the operation of the stirring means; and means for determining the amount of developing material contained in the developer hopper in accordance with the amount of the rays of light received by the light receiving means during the operation of the stirring means.

5. The image forming apparatus as claimed in claim 4, wherein at least one of the incident and exit windows is made of semitransparent material.

6. The image forming apparatus as claimed in claim 5, wherein the image forming unit includes a developing device, a photosensitive medium and a cleaning device.

7. The image forming apparatus as claimed in claim 4, further comprising means for attenuating the rays of light traveling along a path including the incident and exit windows and across the developer hopper.

8. An image forming apparatus which comprises:

a replaceable image forming unit including a developer hopper for accommodating a mass of developing material therein, said developer hopper having an incident window through which external rays of light enter the developer hopper, an exit window through which the rays of light having entered the developer hopper emerge outwardly, and means for stirring the developing material within the developer hopper, at least one of said incident and exit windows being made of a semitransparent material;

a pocket defining structure having a pocket defined therein for replaceably receiving therein the image forming unit;

a light emitting means disposed so as to confront the incident window of the developer hopper;

a light receiving means disposed so as to confront the exit window of the developer hopper;

a first means for detecting the amount of the rays of light received by the light receiving means and for determining, in dependence on the amount of the rays of light received by the light receiving means, whether or not the image forming unit is installed within the pocket, when the image forming apparatus is electrically powered on; and a second means for determining the amount of developing material contained in the developer hopper in dependence on a result of detection by the light receiving means while the stirring means is operated, in the event that the first means determines that the image forming unit has been installed within the pocket.

9. The image forming apparatus as claimed in claim 8, wherein said first means determining that the image forming unit is not installed when the result of detection is greater than a predetermined threshold value and wherein said predetermined threshold value represents the amount of light detected by the light receiving means when the developer hopper is empty.

10. The image forming apparatus as claimed in claim 9, wherein said second means compares the result of detection with a second threshold value which is lower than the predetermined threshold value, and determines that the developer hopper is empty when the result of detection is greater than the second threshold value.

11. An image forming unit adapted to be replaceably installed in an image forming apparatus comprising a detecting means having a light emitting element and a light receiving element for detecting whether or not the image forming unit is installed in the image forming apparatus and also the amount of developing material, said unit comprising:

a developer hopper for accommodating a mass of the developing material;

an incident window through which external rays of light enter the developer hopper; and an exit window through which the external rays of light having entered the developer hopper emerge outwardly, at least one of said incident and exit windows being made of semitransparent material;

said incident and exit windows being arranged on the developer hopper such that the windows are in respective alignment with the light emitting element and the light receiving element when the developer hopper is installed in the image forming apparatus.

12. The image forming unit as claimed in claim 11, further comprising a stirrer means for stirring the developing material within the developer hopper.

13. The image forming unit as claimed in claim 12, wherein said stirrer means cleans each of said incident and exit windows during an operation thereof.

14. The image forming unit as claimed in claim 13, further comprising a photosensitive medium on which an electrostatic latent image is formed, and a developing device for developing the electrostatic latent image on the photosensitive medium with the developing material.

* * * * *